US007343767B2

(12) United States Patent
Bauer et al.

(10) Patent No.: US 7,343,767 B2
(45) Date of Patent: Mar. 18, 2008

(54) ROLLER TOOL FOR THE LINEAR DEFORMATION OF SHEET METAL AND SHEET DEFORMATION FACILITY HAVING SUCH A ROLLER TOOL

(75) Inventors: Hans Jürgen Bauer, Elsbethen (AT); Florian Keller, Weidenberg (DE)

(73) Assignee: Pass Stanztechnik AG, Creussen (DE)

( * ) Notice: Subject to any disclaimer, the term of this patent is extended or adjusted under 35 U.S.C. 154(b) by 71 days.

(21) Appl. No.: 11/339,518

(22) Filed: Jan. 26, 2006

(65) Prior Publication Data

US 2006/0162413 A1 Jul. 27, 2006

(30) Foreign Application Priority Data

Jan. 26, 2005 (DE) ..... 10 2005 003 558

(51) Int. Cl.
*B21B 39/20* (2006.01)
*B21D 5/14* (2006.01)

(52) U.S. Cl. ..... 72/252.5; 492/40; 72/178; 72/182; 72/236

(58) Field of Classification Search ..... 492/40; 72/178, 182, 179, 252.5, 226, 236
See application file for complete search history.

(56) References Cited

U.S. PATENT DOCUMENTS 1,078,240 A * 11/1913 Barbour ..... 72/223
1,302,497 A * 5/1919 Barbour ..... 72/377
2,159,290 A * 5/1939 Penkala ..... 72/238
2,545,976 A 3/1951 Small
3,355,922 A * 12/1967 Utashiro et al. ..... 72/178
4,103,406 A * 8/1978 Ito et al. ..... 492/1
5,109,585 A * 5/1992 Kark ..... 492/2
5,156,034 A 10/1992 Lorbach
5,555,759 A 9/1996 Rosene et al.
6,282,937 B1 * 9/2001 Michaud ..... 72/178

FOREIGN PATENT DOCUMENTS

DE 695 10 771 T2 3/2000
DE 203 15 726 U1 3/2004
EP 0 995 510 A1 4/2000
WO WO 00/23210 A1 4/2000

* cited by examiner

*Primary Examiner*—Dmitry Suhol
(74) *Attorney, Agent, or Firm*—Browdy and Neimark, PLLC

(57) ABSTRACT

A roller tool is used within a sheet deformation facility for the linear deformation of sheet metal. The roller tool comprises a press roller having a shaft and a roller body rolling around the same as well as a counterbody. The press roller and the counterbody can be jointly moved in a linear manner relative to a sheet positioned between them that is to be processed for performing the sheet metal deformation. The roller body has a plurality of roller discs which are adjacent to each other, which together form the section of the roller body that can be placed onto the sheet to be processed and which can rotate around the shaft independently of each other. The sheet deformation facility is furthermore provided with a roller tool support and a drive for pivoting the roller tool support around an axis perpendicular to the sheet that is to be processed.

17 Claims, 6 Drawing Sheets

ROLLER TOOL FOR THE LINEAR DEFORMATION OF SHEET METAL AND SHEET DEFORMATION FACILITY HAVING SUCH A ROLLER TOOL

FIELD OF THE INVENTION

The invention relates to a roller tool for the linear deformation of sheet metal comprising a press roller having a shaft and a roller body which rolls around said shaft, and a counterbody, wherein the press roller and the counterbody together are guidable in a linear manner relative to a sheet to be processed which lies between them to create the deformation of the sheet. Furthermore, the invention relates to a sheet deformation facility having such a roller tool.

BACKGROUND OF THE INVENTION

Such a roller tool as well as a sheet deformation facility having such a roller tool are known from DE 695 10 771 T2. Linear deformations in a work piece can be made by means of such a sheet deformation facility. Bent deformations cannot be made.

SUMMARY OF THE INVENTION

It is, therefore, an object of the present invention to improve a roller tool of the above-mentioned type in such a manner that bent deformations can also be made in a sheet that is to be processed.

This object is accomplished according to the invention by means of a roller tool comprising a plurality of roller discs, which are adjacent to each other and together form a section of the roller body which can be put against the sheet to be processed, and which can rotate around the shaft independently of each other.

According to the invention it was recognised that it is easily possible to produce bent deformations in a work piece when the roller body has a plurality of roller discs which can rotate independently of each other. The roller disc on the inside of the bend can then rotate more slowly than the roller disc on the outside of the bend so that tension forces and shearing forces which so far did not allow the generation of bent deformations with the known roller tools do no longer occur. A differential is created by means of the plurality of roller discs which also allows the generation of bent deformations.

Roller bodies with the different variants of roller disc numbers of more than three, five, eight and ten roller disks have shown to be particularly suited for use in practice.

A profile composition comprising a surrounding surface profile, which is formed from several roller discs having outer surfaces which complete the profile, and a profile composition comprising a surrounding surface profile, which is formed from several roller discs having outer surfaces which complete the profile, provides a roller body with a seamless surrounding profile. This results in beads with a defined and seamless cross-section both in the straight sections and in the bent sections.

A counterbody, which is designed as a roller having a shaft and a counter roller body which rolls around said shaft, co-operates advantageously with the roller body for the deformation of sheet metal.

A counterbody, comprising at least two rollers which can rotate independently of each other around the shaft, has in principle the same advantages as the roller body according to the invention. In particular, the counterbody may, just as the roller body, be formed from a plurality of roller discs.

A sleeve arranged between the shafts of the roller body and/or the counterbody on the one hand, and the roller body and/or the counterbody on the other hand, relative to which sleeve the roller discs of the roller body and/or the rollers of the counterbody can be rotated facilitates the formation of the roller body and/or of the counterbody in particular when the same comprises a larger number of individual discs. When a disc package for forming the profile composition is processed, the sleeve provides in such a case an inner stop which can be used during clamping of the disc package.

A lubricating facility for lubricating the roller body and/or the counterbody facilitates an automated lubrication of the roller body and/or of the counterbody.

A lubricating facility comprising a lubricant reservoir which is housed in the shaft of the roller body and/or the counterbody and communicating via at least one connection channel with an outer surface of the shaft provides the lubricant easily where it is needed for lubrication. The lubricant reservoir can be sized such that the lubrication is ensured over a long period of time until a re-filling of the lubricant reservoir, for instance via a commercially available lubricating nipple which is accessible from outside, becomes necessary. A penetrating oil may, for instance, be used as lubricant.

A plurality of connection channels via which the lubricant reservoir communicates with the outer surface facilitates a uniform lubrication of the roller body and/or of the counterbody.

The same applies to connection channels opening out from the outer surface of the shaft distributed in the direction of the circumference around the shaft. It is moreover ensured here that a unilateral load on the roller body and/or on the counterbody in the direction of the circumference around the shaft does not lead to an undesirable occlusion of all connection channels in the area where they open out from the outer surface.

A power storing device, in particular a compression spring, which acts via a plunger upon the contents of the lubricant reservoir, provides for a reliable lubricant supply. Alternatively or additionally, the lubricant supply can be ensured, for instance, through the influence of the force of gravity, through the penetration ability of the lubricant or through a capillary action.

It is a further object of the invention to provide a sheet deformation facility by means of which also bent linear deformations of sheet metal can be made.

This object is accomplished according to the invention by a sheet deformation facility comprising a roller tool as described above, a roller tool support and a drive for pivoting the roller tool support around an axis vertically to the sheet to be processed.

The advantages of the sheet deformation facility are in conformity with those that were already mentioned with respect to the roller tool.

Examples of the invention will be explained below in greater detail by reference to the drawings.

DESCRIPTION OF THE PREFERRED EMBODIMENTS

Figure 1:
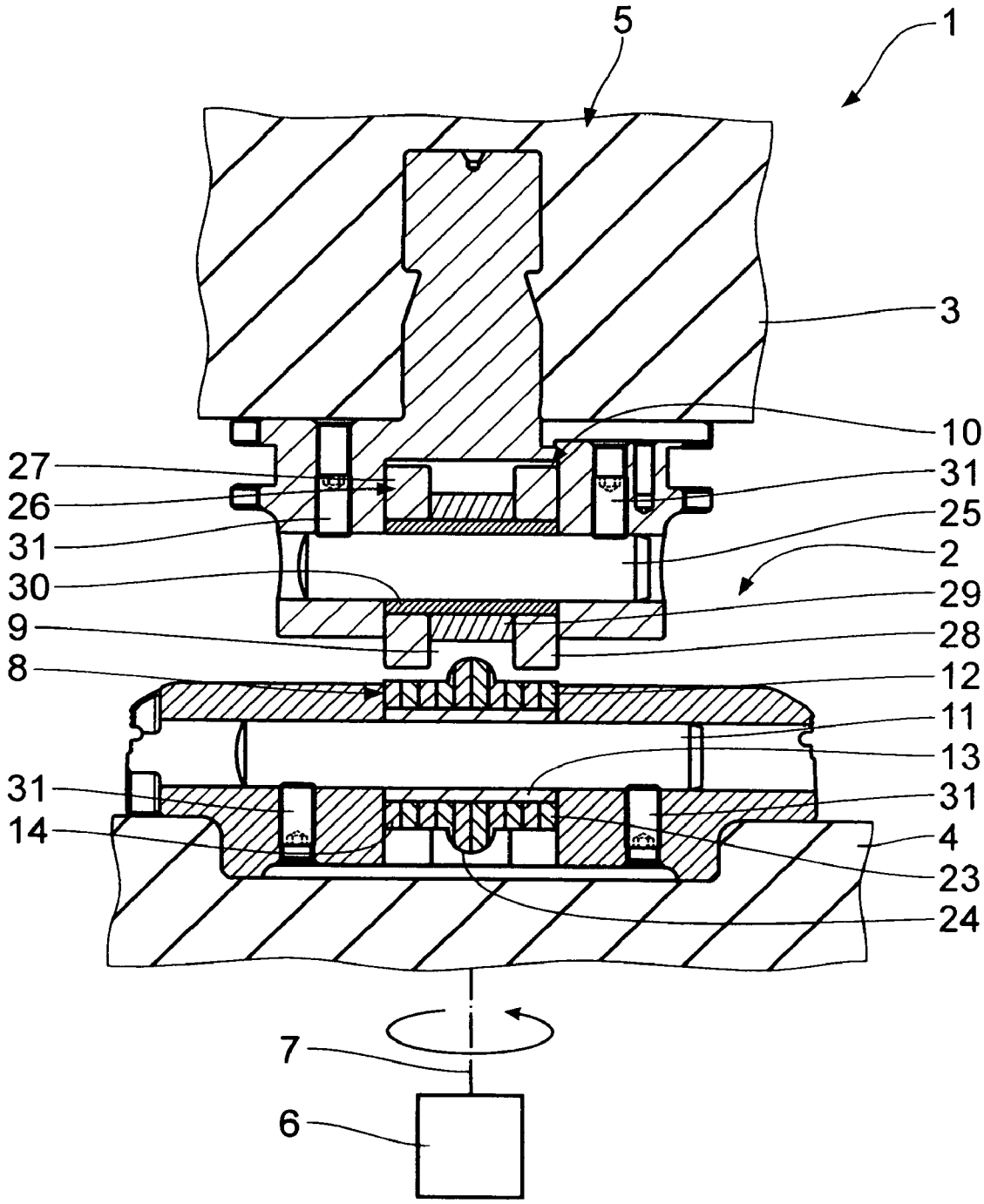
FIG. 1 shows a vertical sectional elevation of a section of a sheet deformation facility with a roller tool.
Figure 2:
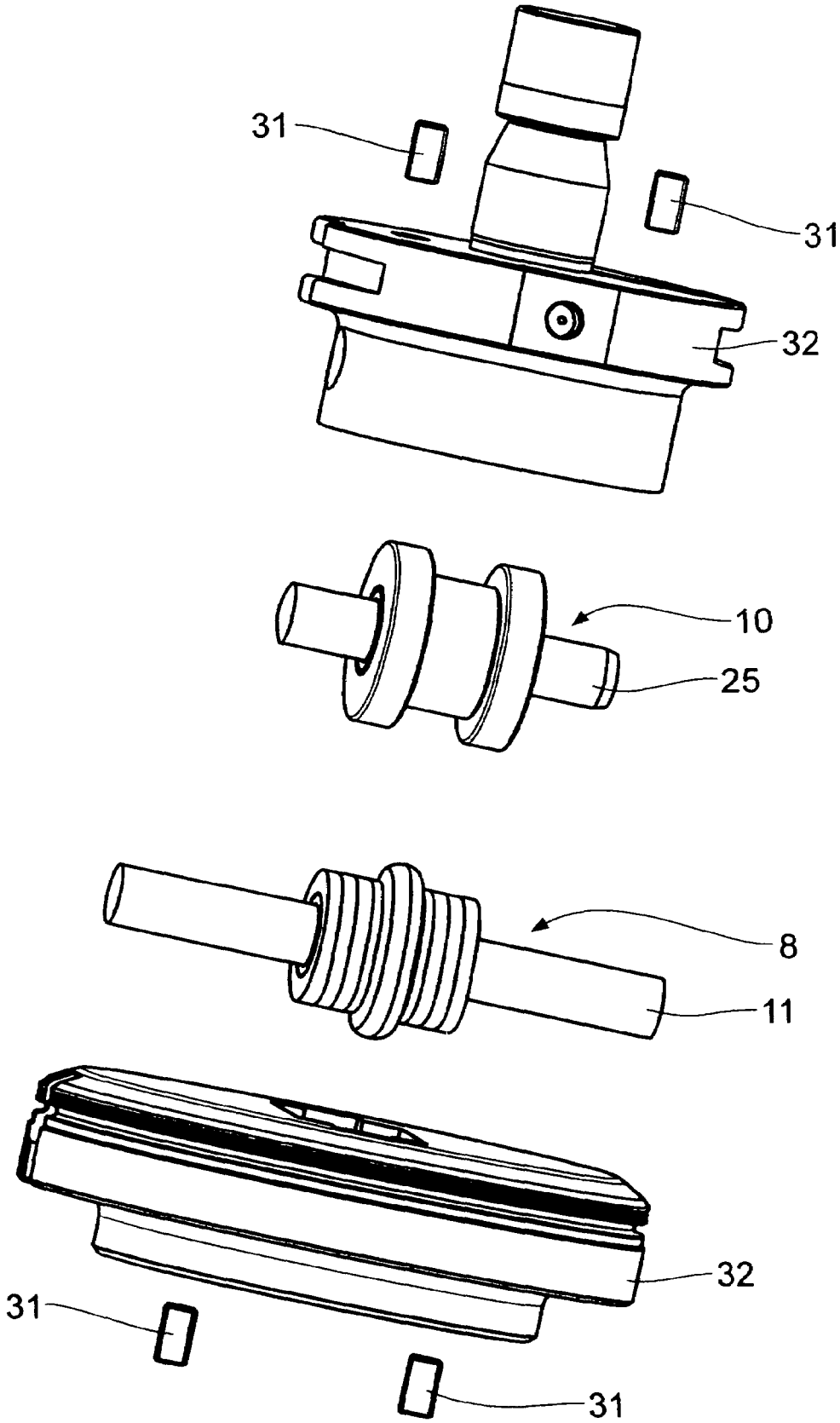
FIG. 2 shows an exploded view of the roller tool of the sheet deformation facility according to FIG. 1.

A sheet deformation facility 1 as shown in FIG. 1 is used for the linear deformation of sheet metal, in particular for the forming of beads. The sheet deformation facility 1 comprises a roller tool 2 which is held by a roller tool support 5 which is schematically illustrated in sections 3, 4 only. The roller tool support 5 is connected with a drive 6 as is schematically indicated in FIG. 1. Drive 6 permits pivoting and/or rotation of the roller tool support 5 together with the roller tool 2 around a pivoting and/or rotation axis 7. The pivoting axis 7 is vertical to the sheet which is being processed with the roller tool 2 and which is not shown in the drawing.

The roller tool 2 comprises a press roller 8 which is arranged in FIG. 1 below a sheet metal deformation zone 9 of the sheet deformation facility 1. For the sheet metal deformation, the press roller 8 co-operates with a hydraulically operable counterbody 10 in the sheet metal deformation zone 9. In sheet metal deformation, the sheet that is to be processed is arranged in the sheet metal deformation zone 9 between the press roller 8 and the counterbody 10 such that the sheet is oriented vertically on the drawing plane of FIG. 1 and horizontally in FIG. 1.

The press roller 8 includes a shaft 11 and a roller body 12 which rolls around the same. A sleeve 13 is arranged between shaft 11 and roller body 12 the extension of which along shaft 11 corresponds to that of the roller body 12. Sleeve 13 is rotatable around shaft 11.

Figure 3:
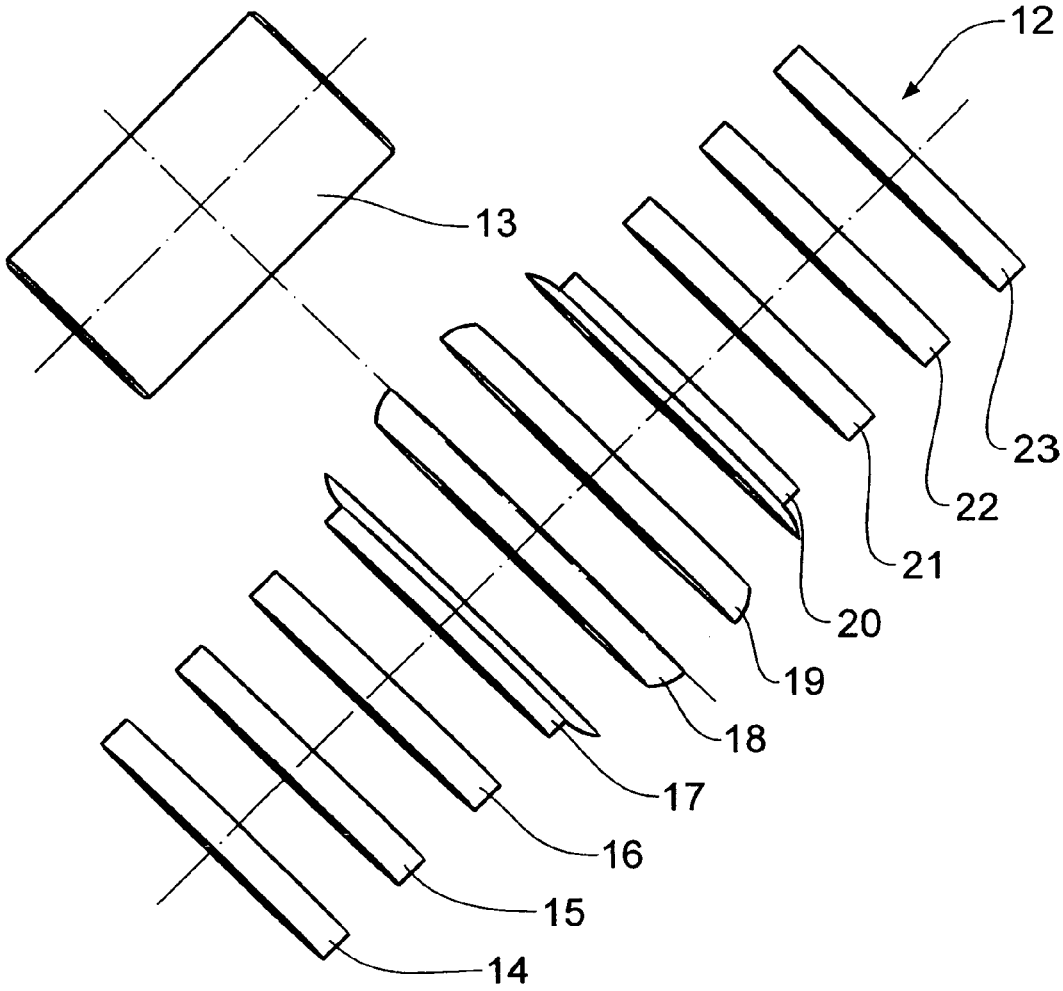
FIG. 3 shows an enlarged exploded view of a roller body of the roller tool with a sleeve.

The roller body 12 is divided into a plurality of individual roller discs 14 to 23 which are numbered rising from bottom left to top right in FIG. 3. The roller discs 14 to 23 are adjacent to each other and together form the section of the roller body 12 which can be put against the sheet to be processed. The roller discs 14 to 23 can rotate around sleeve 13 independently of each other and thus also around shaft 11. In order to facilitate the relative rotation of the roller discs 14 to 23 towards each other, the adjacent areas of the roller discs 14 to 23 are lubricated.

Figure 4:
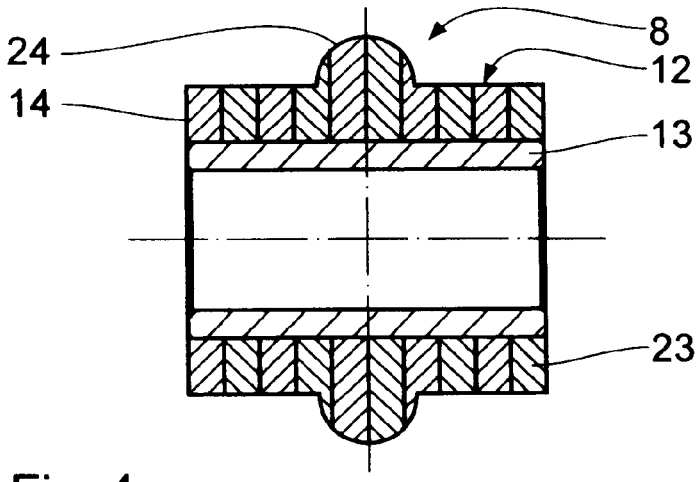
FIG. 4 shows the roller body in an illustration which is also enlarged when compared to FIG. 1.
Figure 5:
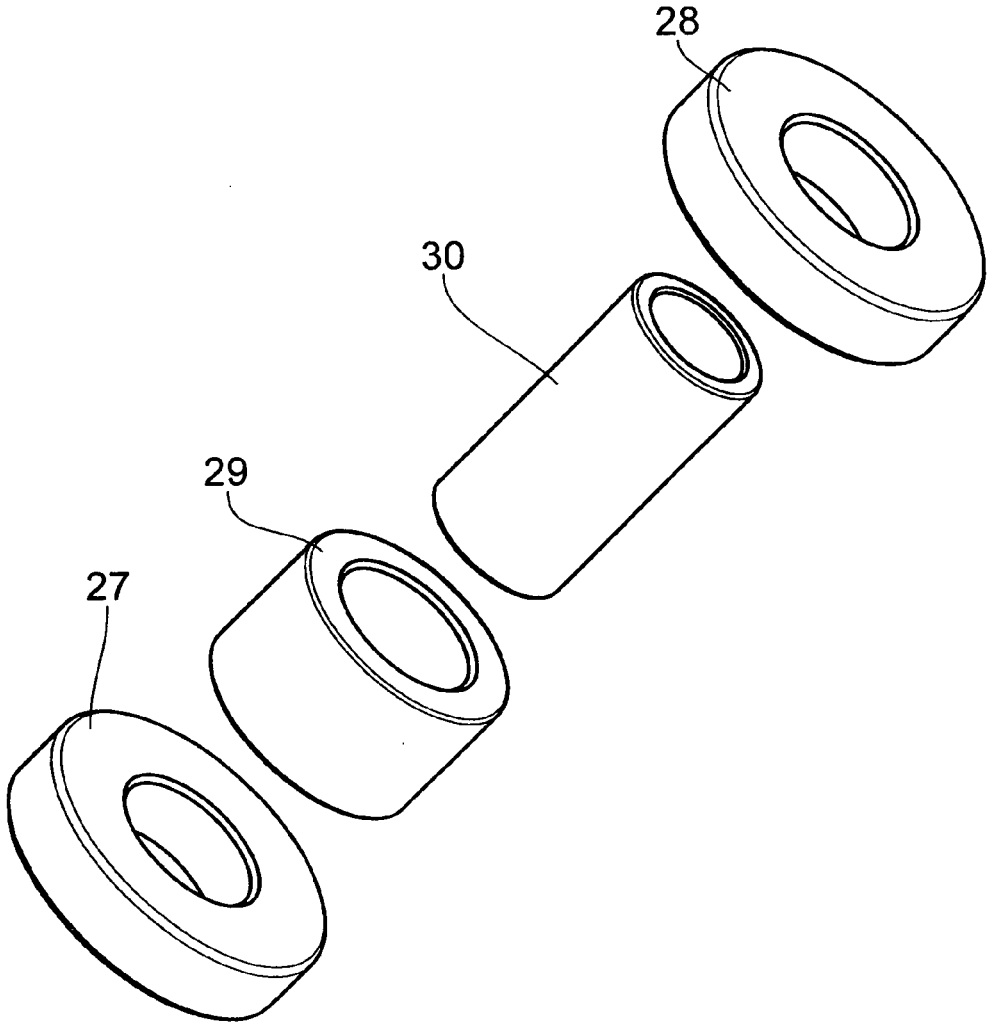
FIG. 5 is an exploded view similar to FIG. 3 of a counterbody of the roller tool with a sleeve.
Figure 6:
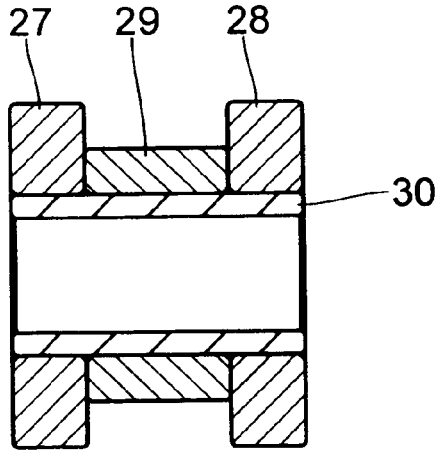
FIG. 6 is an illustration of the counterbody similar to that in FIG. 4.

The illustrated embodiment comprises a total of ten roller discs 14 to 23. The ten roller discs 14 to 23 form a roller disc package. The roller discs 14 to 23 each have outer surfaces which seamlessly complete a surrounding profile section of the roller body 12 which can in particular be seen in FIG. 4. The surrounding profile section of the roller body 12 has a centrally surrounding bulb 24 by means of which the bead in the sheet that is to be processed is formed. This bulb 24 which constitutes a convex profile section of the surrounding profile section of the roller body 12 is formed from the outer surfaces of the four central roller discs 17 to 20. The outer roller discs 14 to 16 and 21 to 23 are configured as rings with plane outer surfaces.

Counterbody 10 is also configured as a roller with a counterbody shaft 25 and a counter-roller body 26 which rolls around the same. The counter-roller body 26 comprises two annular rollers 27, 28 which can rotate around the counterbody shaft 25 independently of each other. A distance sleeve 29 is provided on the counterbody shaft 25 between the rollers 27, 28. A counterbody sleeve 30 is arranged between the counterbody shaft 25 and the counter-roller body 26. The two rollers 27, 28 can rotate around the counterbody shaft 25 independently of each other.

Shafts 11, 25 are held rotation-proof in associated shaft recesses 32 by means of headless screws 31.

The sheet deformation facility 1 is operated as follows: After the positioning of the sheet that is to be processed in the sheet deformation zone 9 between the press roller 8 and the counterbody 10, the counterbody 10 is hydraulically advanced towards the press roller 8. Once a predetermined force of pressure between the press roller 8 and the counterbody 10 has been reached, the roller tool 2 moves in a linear direction relative to the plane of the sheet following the shape of the bead that is to be formed. The bead need not run straight along the sheet but can in particular also be bent and/or curved. For the formation of such a bent bead the roller tool 2 follows the line direction of the bead in such a manner that the shafts 11, 25 are at any time positioned approximately vertically on the section of the bead that is to be formed. For this purpose, the roller tool 2 is pivoted via drive 6 around the pivoting axis 7 into the respective required pivoting position while the bead is being followed.

While the roller tool 2 follows a bent bead direction, the roller discs 14 to 23 on the outside of the bend and the rollers 27, 28 on the outside of the bend must travel over a longer distance than the roller discs 14 to 23 on the inside of the bend and the rollers 27, 28 on the inside of the bend. The components on the outside of the bend which are adjacent to the sheet that is to be processed will then rotate more quickly than the components on the inside of the bend which are adjacent to the sheet. The division of the roller body 12 into the roller discs 14 to 23 on the one hand and the division of the counterbody 10 into the rollers 27, 28 act therefore as a differential when the bent bead section is followed.

It will be appreciated that alternatively it is possible when the roller tool 2 is stationary to move the sheet relative to the roller tool 2 in such a manner that the bead line is followed through this relative movement. In this case, too, the described differential effect of the roller discs 14 to 23 and of the rollers 27, 28 is accomplished when a bent bead section is followed.

In an alternative embodiment of the roller tool 2 the counterbody 10, too, is formed from a plurality of counterbody roller discs which jointly form a roller package in particular with a profile that is complementary to the profile of the roller package of roller body 12.

Other embodiments of the roller body 12 have three, five, or eight roller discs.

Figure 7:
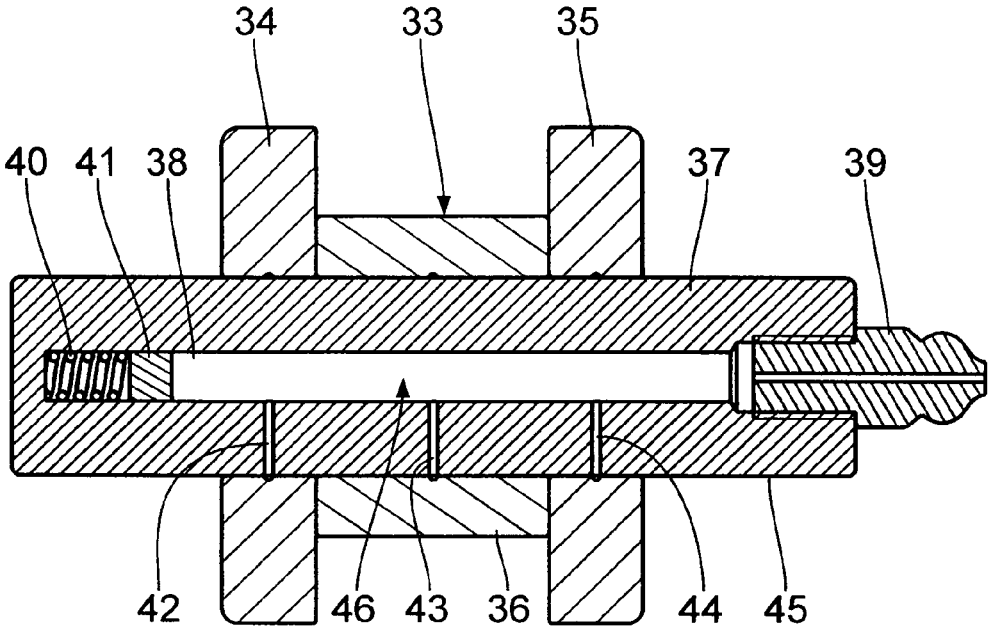
FIG. 7 shows another embodiment of a counterbody having a lubricating facility accommodated in a counterbody shaft, in a vertical sectional elevation.
Figure 8:
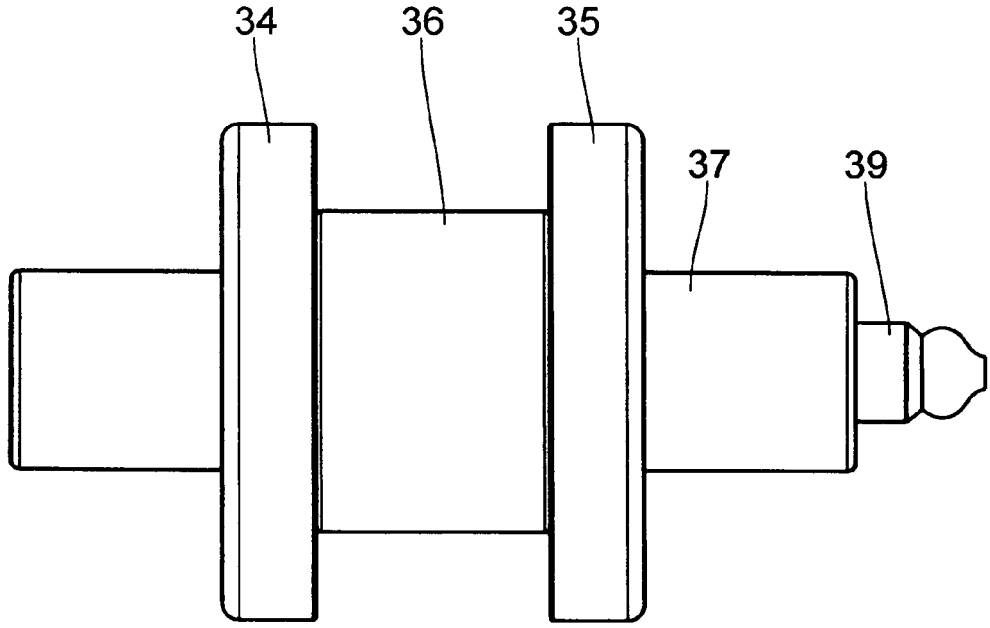
FIG. 8 shows the counterbody having the lubricating facility according to FIG. 7 in a side view.
Figure 9:
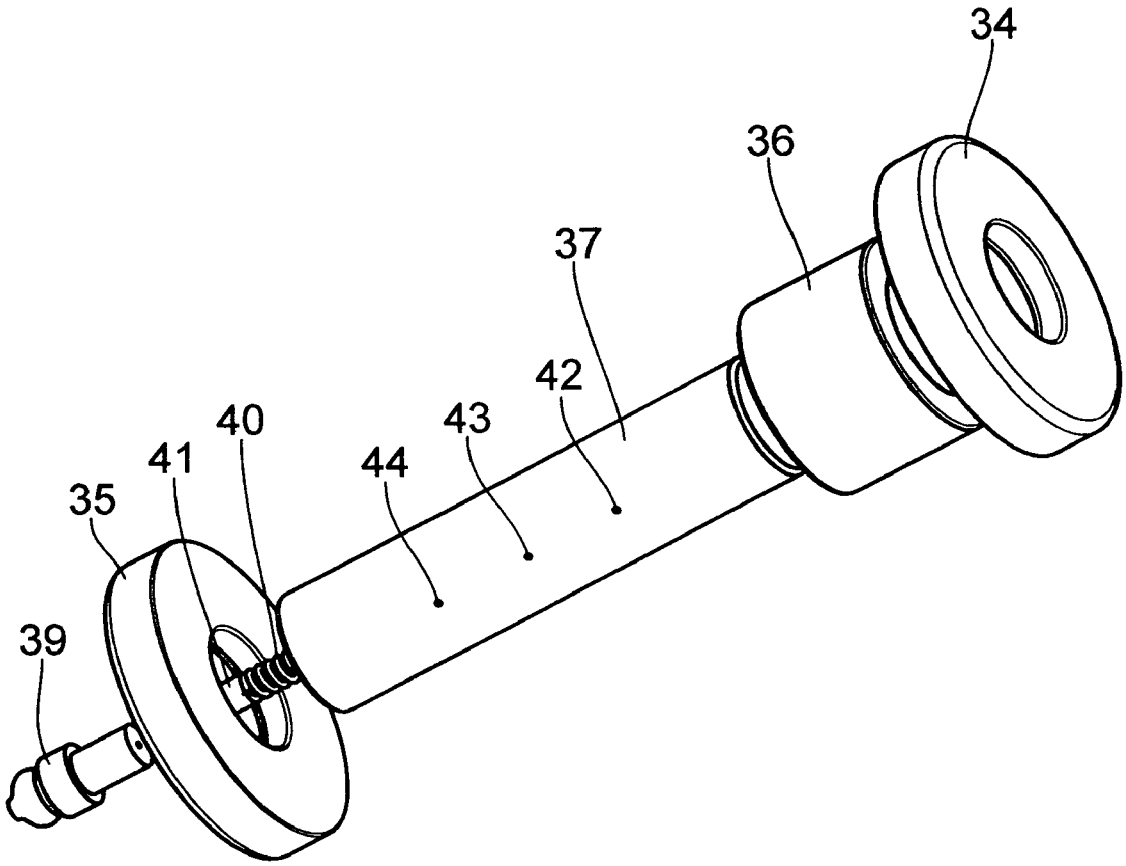
FIG. 9 shows the counterbody having the lubricating facility according to FIG. 7 in an exploded view.

Another embodiment of a counterbody 33 for use in a sheet deformation facility of the type as described above with reference to FIG. 1 to FIG. 6 is shown in FIG. 7 to FIG. 9. Components which correspond to those that were already described above with reference to FIG. 1 to FIG. 6 have the same reference numerals and are not discussed again in detail.

The counterbody 33 has rollers 34, 35 with a distance sleeve 36 arranged between them. Apart from differences as to dimensions, the rollers 34, 35 as well as the distance sleeve 36 correspond to the rollers 27, 28 as well as to the distance sleeve 29 of the embodiment of the counterbody 10 according to FIG. 1 to FIG. 6. The counterbody 33 has no counterbody sleeve 30. A counterbody shaft 37 has a lubricant reservoir 38 in the form of a central pocket bore which runs along shaft 37. The lubricant reservoir 38 is closed on its face, in FIG. 7 and FIG. 8 to the right, by means of a commercially available lubricating nipple 39 with check valve. Opposite the lubricating nipple 39, i.e. on the bottom of the pocket bore, a compression spring 40 is arranged in the lubricant reservoir 38 which is supported on one side on the bottom of the pocket bore and on the other side on a pressure plunger 41. By means of the pressure plunger 41 the compression spring 40 applies pressure onto the contents of the lubricant reservoir 38, i.e. onto the lubricant contained therein in the form of, for instance, a penetrating oil.

The lubricant reservoir 38 is in fluid connection with an outer surface 45 through a plurality of connection channels 42 to 44 which are configured as tap lines. The illustrated embodiment provides for three connection channels 42 to 44 which are arranged at an equal distance from each other and all of which open out downwardly so that lubricant is exiting under the influence of the force of gravity even without the operation of compression spring 40. Depending upon the lubricant that is used and depending upon the width of the opening of the connection channels 42 to 44, lubricant may exit also without the operation of the compression spring and without the influence of the force of gravity owing to the penetration ability of the lubricant and/or owing to a capillary effect. Lubricant may also exit under the influence of a thermal expansion of the lubricant during the operation of the sheet deformation facility 1.

In an embodiment that is not shown, the connection channels 42 to 44 open out from the outer surface 45 of the shaft 37 distributed in the direction of circumference around the shaft 37.

Other numbers of connection channels are also possible.

The components with the reference numerals 38 to 44 form a counterbody lubricating facility 46. A roller body lubricating facility can be designed correspondingly. Here, in particular the number and the arrangement of the connection channels can be adapted to the number and to the thickness of the roller discs 14 to 23. For instance, a roller body lubricating facility may have as many connection channels as roller discs.

What is claimed is:

1. A roller tool (2) for the linear deformation of sheet metal comprising a press roller (8) having a shaft (11) and a roller body (12) which rolls around said shaft;

comprising a counterbody (10);

wherein the press roller (8) and the counterbody (10) together are guidable in a linear manner relative to a sheet to be processed which lies between them to create the deformation of the sheet wherein the roller body (12) comprises a plurality of roller discs (14 to 23), which are adjacent to each other and together form a section of the roller body (12) which can be put against the sheet to be processed;

can rotate around the shaft (11) independently of each other, the roller tool comprising a lubricating facility (46) for lubricating the roller body (12), wherein the lubricating facility (46) comprises a lubricant reservoir (38) which is housed in the shaft (11, 25) of the roller body (12), the reservoir (38) communicates via at least one connection channel (42 to 44) with an outer surface (45) of the shaft (11, 25).

2. A roller tool according to claim 1, comprising more than three roller discs (14 to 23).

3. A roller tool according to claim 1, wherein the roller body (12) comprises a surrounding surface profile, which is formed from several roller discs (14 to 23) having outer surfaces which complete the profile.

4. A roller tool according to claim 3, wherein the profile comprises a surrounding convex profile section (24), which itself is formed from several roller discs (17 to 20), having outer surfaces which complete the profile section.

5. A roller tool according to claim 1, wherein the counterbody (10) is also designed as a roller having a shaft (25) and a counter roller body (26) which rolls around said shaft.

6. A roller tool according to claim 5, wherein the counterbody (10) comprises at least two rollers (27, 28) which can rotate independently of each other around the shaft (25).

7. A roller tool according to claim 1, wherein between the shaft (11) of the roller body (12) on the one hand, and the roller body (12) on the other hand, a sleeve (13) is arranged relative to which the roller discs (14 to 23) of the roller body (12) can be rotated.

8. A roller tool according to claim 1, comprising a plurality of connection channels (42 to 44) via which the lubricant reservoir (38) communicates with the outer surface (45).

9. A roller tool according to claim 8, wherein the connection channels (42 to 44) open out from the outer surface (45) of the shaft (11, 25; 37) distributed in the direction of circumference around the shaft (11, 25; 37).

10. A roller tool according to claim 1, wherein the lubricating facility (46) comprises a power storing device, which acts via a plunger (41) upon the contents of the lubricant reservoir (38).

11. A roller tool according to claim 1, comprising more than five roller disks (14 to 23).

12. A roller tool according to claim 1, comprising more than eight roller disks (14 to 23).

13. A roller tool according to claim 1, comprising more than ten roller disks (14 to 23).

14. A roller tool according to claim 1, wherein between the shaft (25) of the counterbody (10) on the one hand, and the counterbody (10) on the other hand, a sleeve (30) is arranged relative to which the roller discs (14 to 23) of the counterbody (10) can be rotated.

15. A roller tool (2) for the linear deformation of sheet metal comprising a press roller (8) having a shaft (11) and a roller body (12) which rolls around said shaft;

comprisng a counterbody (l0);

wherein the press roller (8) and the counterbody (10) together are guidable in a linear manner relative to a sheet to be processed which lies between them to create the deformation of the sheet wherein the roller body (12) comprises a plurality of roller discs (14 to 23), which are adjacent to each other and together form a section of he roller body (12) which can be put against the sheet to be processed;

can rotate around the shaft (11) independently of each other, the roller tool comprising a lubricating facility (46) for lubricating the counterbody (10)

wherein the lubricating facility (46) comprises a lubricant reservoir (38) which is housed in the shaft (37) of the counterbody (10), the reservoir (38) communicates via at least one connection channel (42 to 44) with an outer surface (45) of the shaft (37).

16. A roller tool according to claim 10, wherein the power storing device is a compression spring (40).

17. A sheet deformation facility (1) comprising a roller tool according to claim 1 a roller tool support (5)

a drive (6) for pivoting the roller tool support (5) around an axis (7) vertically to the sheet to be processed.

* * * * *